United States Patent [19]

Gordon

[11] 3,966,112

[45] June 29, 1976

[54] TWO-PIECE, POLYGONAL CONTAINER

[75] Inventor: Robert Louis Gordon, Monroe, N.Y.

[73] Assignee: International Paper Company, New York, N.Y.

[22] Filed: Dec. 23, 1974

[21] Appl. No.: 536,007

[52] U.S. Cl. ..... 229/23 BT; 229/31 R; 229/43

[51] Int. Cl.[2] ..... B65D 5/12

[58] Field of Search ..... 229/23 BT, 23 R, 31 R, 229/31 FS, 5.5, 43, 44

[56] References Cited

UNITED STATES PATENTS

| | | | |
|---|---|---|---|
| 987,280 | 3/1911 | Bachmann | 229/31 FS |
| 2,071,949 | 2/1937 | Reich | 229/31 R |
| 2,073,272 | 3/1937 | Wellman | 229/23 R X |
| 2,085,038 | 6/1937 | Perreton | 229/31 R |
| 2,234,193 | 3/1941 | Peters | 229/23 R |
| 3,423,008 | 1/1969 | Mykleby | 229/23 R X |
| 3,542,569 | 11/1970 | Farquhar | 229/31 R X |
| 3,670,951 | 6/1972 | Smith | 229/43 |
| 3,833,113 | 9/1974 | Osier | 229/31 R X |

*Primary Examiner*—Davis T. Moorhead
*Attorney, Agent, or Firm*—Ronald A. Schapira

[57] ABSTRACT

A two-piece container, for sandwiches and the like, having a paperboard base, which includes a central, polygonal, bottom panel of at least four sides; at least four, upstanding, side wall panels, preferably connected to the sides of the bottom panel; at least four, triangular gusset panels, each gusset panel being located between and foldably connected to two, adjacent, side wall panels; and at least two, downwardly extending, base-locking flaps, foldably connected to the top edges of at least two, non-adjacent, side wall panels; the central, leading edge portions of each base-locking flap being adhesively bonded to the underlying surface of a side wall panel; and each of the gusset panels being folded so that it lies substantially flat against a surface of a side wall and is overlain by a base-locking flap. The top edges of each gusset panel are substantially colinear with the lateralmost, lateral edge portions of an overlying, base-locking flap. In this container, the base can also include at least two, outwardly and downwardly extending, lid-locking flaps, foldably connected to the top edges of at least two other, non-adjacent, side wall panels; and the container can further include a lid, covering the base, which has a central, polygonal, top panel of at least four sides; at least four, downwardly extending, side wall panels, connected to the sides of the top panel and overlying a portion of the outer surfaces of the side wall panels of the base; and at least two, inwardly and upwardly extending, lid-locking flaps, foldably connected to the bottom edges of at least two, side wall panels of the lid; the leading edges of the lid-locking flaps on the base extending outwardly of the leading edges of the lid-locking flaps on the lid.

9 Claims, 12 Drawing Figures

FIG. 1
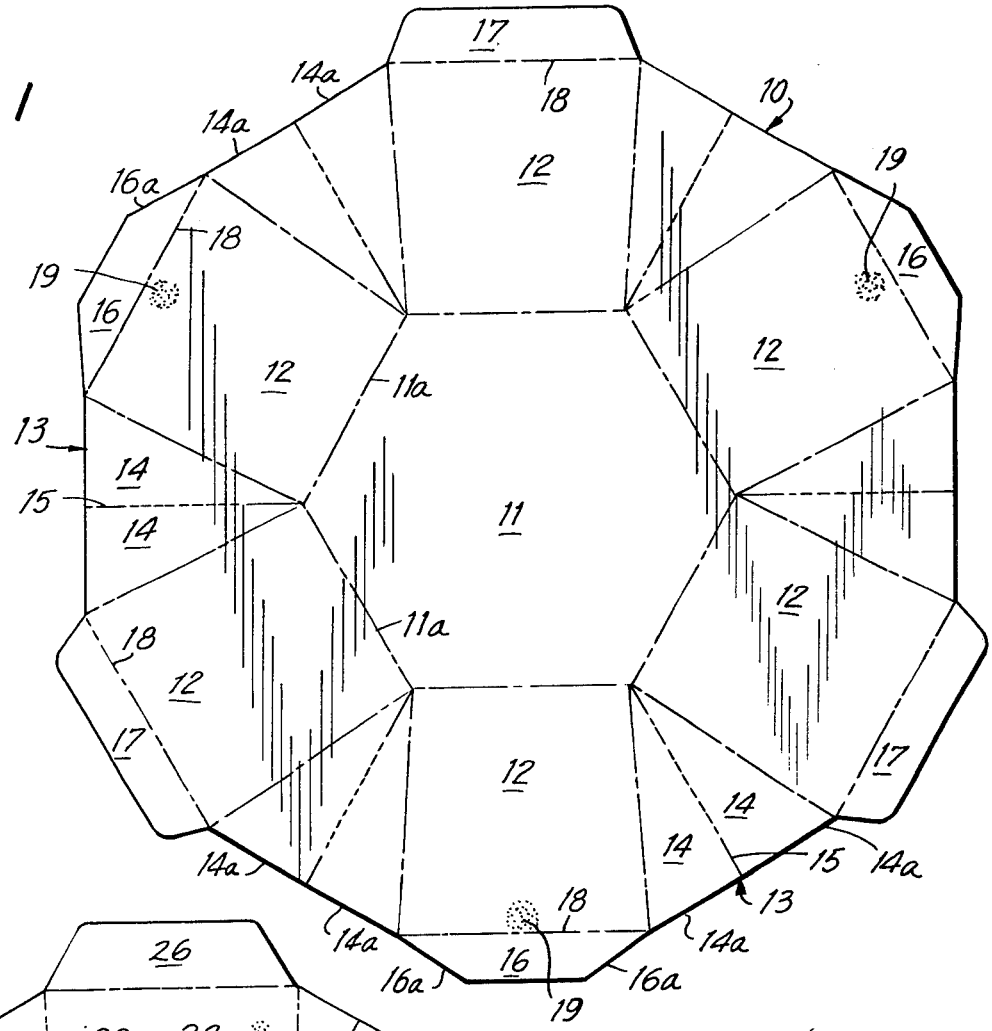
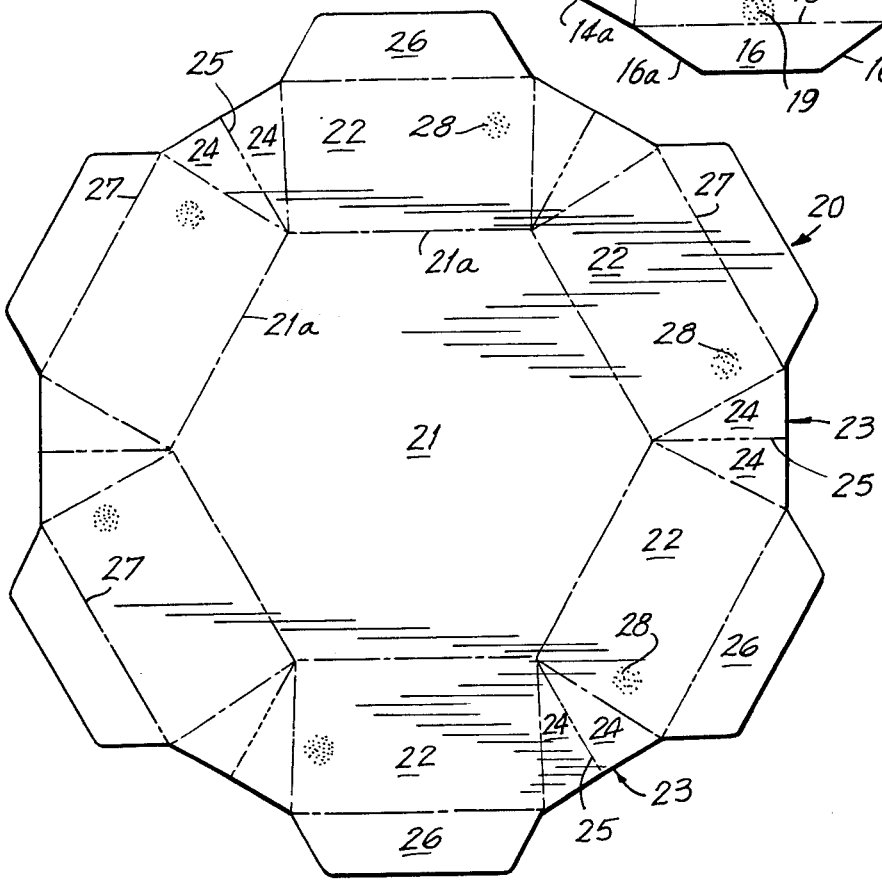
FIG. 2

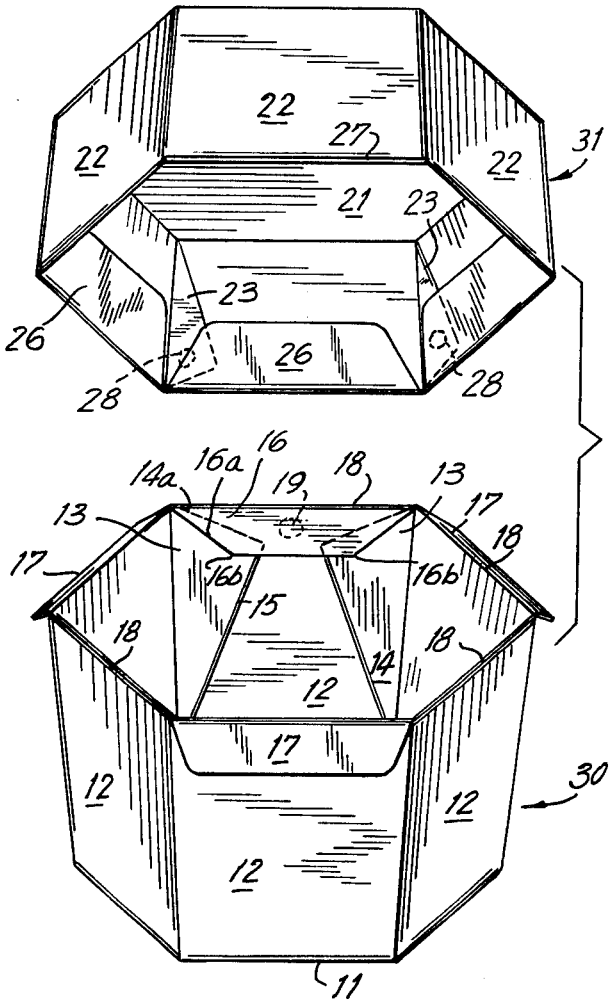
FIG. 3
FIG. 4
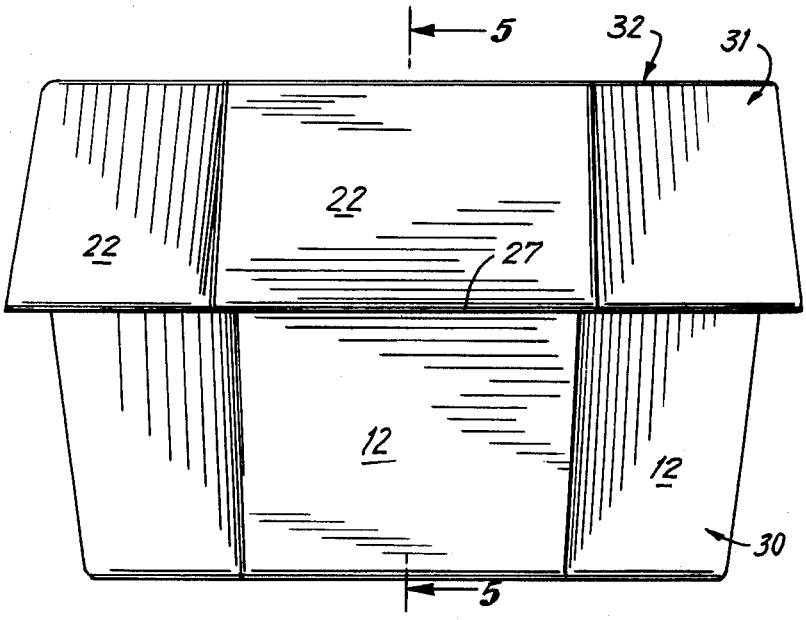

FIG. 7
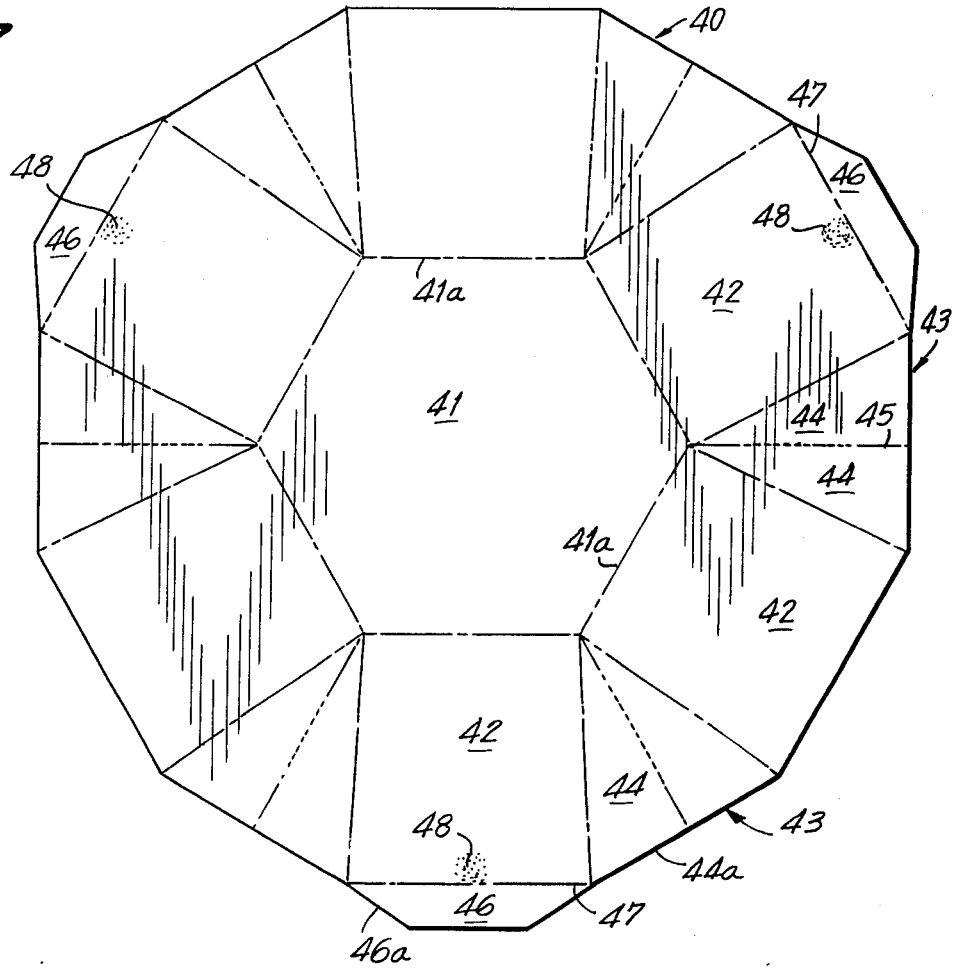
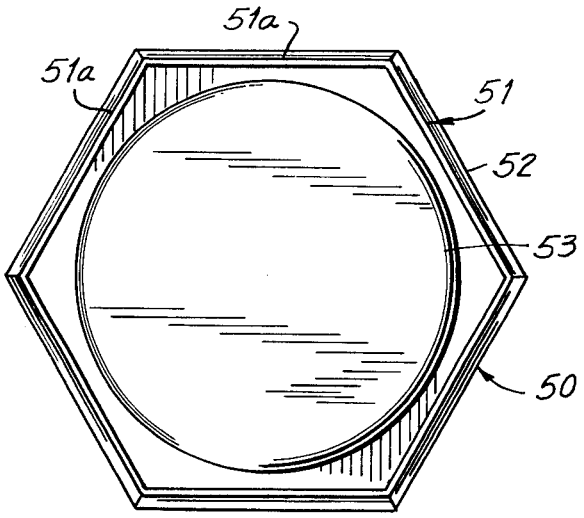
FIG. 8

TWO-PIECE, POLYGONAL CONTAINER

BACKGROUND OF THE INVENTION

This invention relates to a two-piece container for sandwiches, hamburgers and the like. This invention particularly relates to a two-piece container which can be securely closed to protect the contents of the container but which also can be easily opened by the consumer of the container's contents. This invention also particularly relates to a two-piece container in which the base member can be expeditiously disassembled to provide a flat serving plate for the contents of the container, after the container has been opened by the consumer. This invention is quite particularly concerned with two-piece containers for high volume, take-out food establishments.

Paperboard containers for food products, such as sandwiches and the like, which can be opened and disassembled to provide a flat blank for storage purposes or for serving the food products, are generally known in the art. See, for example, U.S. Pat. Nos. 2,071,949, 2,085,038, 3,327,921, 3,542,569, 3,627,541 and 3,658,234.

However, all these containers have been somewhat unsatisfactory in one or more respects for use by establishments which provide a high volume, take-out service for food products, such as sandwiches, hamburgers and the like. Such establishments have required a container which can be pressembled and can be easily and quickly filled with a food product. Such establishments have also required a container which can be easily and quickly closed after being filled with a food product. Such establishments have further required a container having a preformed base, adapted to have the ingredients of the sandwich, hamburger of the like (e.g., the bread, meat, relish, etc.) individually placed in it when preparing the sandwich, hamburger, etc. for the take-out service. Such establishments have still further required a container which, when filled, remains closed and in which a heated, food product is protected against undue loss of heat until the consumer opens the container. In addition, such establishments have required a container which can be easily opened by the consumer and disassembled to form a flat plate for catching drippings and crumbs from the sandwich or the like while it is being consumed.

In heretofore available containers for food products, completely filling and closing the containers generally has not been a very easy or quick procedure. In many containers, the walls of the container base have had to be folded in a particular way so that the base can receive the food product. Also, in many containers, flaps on the container lid have had to be inserted in slits in the side walls of the container base to close the containers. See, for example, U.S. Pat. Nos. 3,542,569 and 3,627,541. Also, such containers often have not been well adapted to being easily opened by the consumer of the food product. See, for example, U.S. Pat. No. 3,327,921, wherein locking flaps have had to be unfolded in order to get at the contents of the container. Furthermore, such containers often have included relatively complicated constructions, which have tended to get in the way of quickly and easily closing them. See, for example, U.S. Pat. No. 2.085,038, wherein the plurality of flaps, provided about the rim of the container base, have constituted a substantial hindrance to lidding the base to provide a closed container. Still another problem with heretofore available containers has been the relative difficulty in disassembling their bases to form flat plates. See, for example, U.S. Pat. No. 2.071,949, wherein disassembling the container has involved individually unfolding the interfolded flaps at each corner of the container.

SUMMARY OF THE INVENTION

In accordance with this invention, a two-piece, polygonal container is provided which comprises a paperboard base, having:

- a central, polygonal, bottom panel of at least four sides;
- at least four, upstanding, side wall panels, foldably connected to the sides of the bottom panel;
- at least four, triangular gusset panels, each gusset panel being located between and foldably connected to two, adjacent, side wall panels; and
- at least two, downwardly extending, base-locking flaps, foldably connected to the top edges of at least two, non-adjacent, side wall panels;
- the central, leading edge portions of each baselocking flap being bonded to thte underlying surface of a side wall panel;
- each of the triangular gusset panels being folded so that it lies substantially flat against a surface of a side wall panel and is overlain by a base-locking flap; and
- the top edges of each gusset panel being substantially colinear with the lateralmost, lateral edge portions of an overlying, base-locking flap. By this container construction, a base member is provided which can be preassembled and which can be easily and quickly filled and securely lidded by a high volume vendor of sandwiches, hamburgers and the like. The base of the container also can be easily disassembled to form a flat plate, when the contents of the container are to be consumed.

In accordance with a second embodiment of this invention, the two-piece, polygonal container also comprises:

- at least two, outwardly and downwardly extending, lid-locking flaps, foldably connected to the top edge of at least two other, non-adjacent, side wall panels of the base; and
- a paperboard lid covering the base, having a central, polygonal, top panel of at least four sides; at least four, downwardly extending, side wall panels, connected to the sides of the top panels and overlying a portion of the outer surfaces of the side wall panels of the base; and at least two, inwardly and upwardly extending, lid-locking flaps, foldably connected to the bottom edge of at least two, side wall panels of the lid;
- the leading edges of the lid-locking flaps on the base extending outwardly of the leading edges of the lid-locking flaps on the lid.

By this construction, a two-piece container is provided, the lid and base elements of which can be preassembled and nested in a stack and which can be easily and quickly filled and closed. The container also can be easily opened and its base disassembled to form a flat plate, by the consumer of the contents of the container.

BRIEF DESCRIPTION OF THE DRAWINGS

FIG. 1 is a plan view of a cut and scored, paperboard blank which can be formed into a base member of the two-piece, polygonal container of this invention.

FIG. 2 is a plan view of a cut and scored, paperboard blank which can be formed into a lid member of the container of this invention.

FIG. 3 is an exploded, perspective view of a two-piece, polygonal container of this invention. The base of the container is formed from the blank of FIG. 1, and the lid of the container is formed from the blank of FIG. 2.

FIG. 4 is a front, plan view of the container of this invention, shown in FIG. 3.

FIG. 7 is a plan view of a cut and scored, paperboard blank for forming a tray member in accordance with an alternative embodiment of the two-piece, polygonal container of this invention.

FIG. 8 is a plan view of the bottom of a preformed, plastic lid member in accordance with the alternative embodiment of the container of this invention.

DETAILED DESCRIPTION OF THE INVENTION

Figure 5:
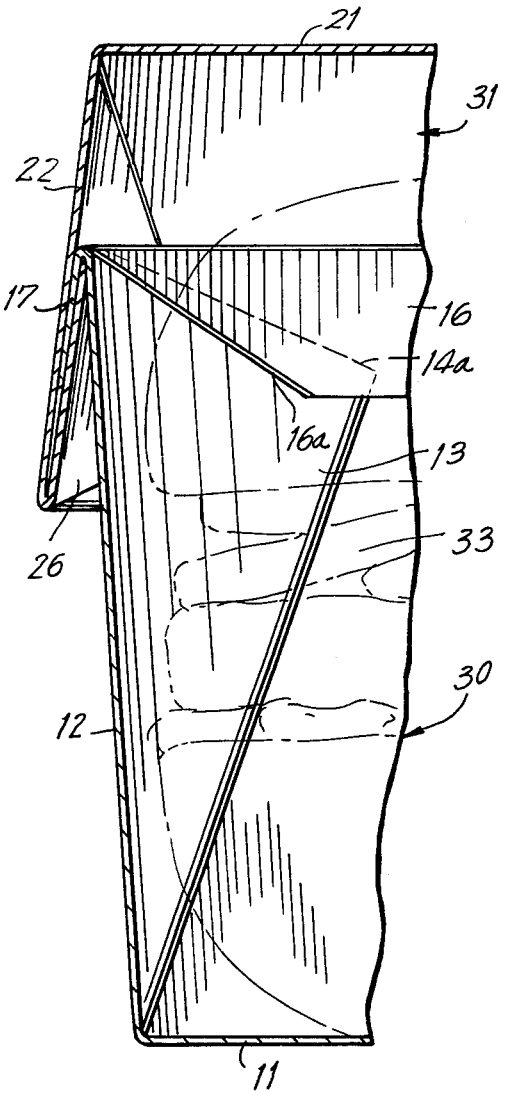
FIG. 5 is a fragmentary, sectional view taken along line 5—5 in FIG. 4.

Shown in FIG. 1 is a paperboard blank, generally 10, for forming a base member of a two-piece, polygonal container of this invention. The base blank 10 includes a central, polygonal, bottom panel 11 of at least four sides or edges 11*a* and at least four, side wall panels 12, foldably connected to the sides 11*a* of the bottom panel 11. The base blank 10 also includes at least four, triangular gusset panels 13. Each gusset panel 13 is located between and foldably connected to two, adjacent, side wall panels 12. Each of the gusset panels 13 consists of a pair of triangular panels 14. The triangular panels 14 in each gusset panel 13 are foldably connected along a cut and scored, fold line 15, between them. The fold line 15 in each gusset panel 13 is equidistant from the lateral edges of the adjacent, side wall panels 12.

The base blank 10 further includes at least two, base-locking flaps 16, foldably connected to at least two, non-adjacent, side wall panels 12. The base-locking flaps 16 are attached to the outer edges of the side wall panels 12, remote from the bottom panel 11. Preferably, each base-locking flap 16 has a substantially trapezoidal shape, the longer base of which is connected to a side wall panel 12.

The base blank 10 still further includes at least two, lid-locking flaps 17, foldably connected to at least two other, non-adjacent, side wall panels 12. Each lid-locking flap 17 is attached to the outer edge of a side wall panel 12, remote from the bottom panel 11. Preferably, each lid-locking flap 17 has a generally trapezoidal shape, the longer base of which is connected to a side wall panel 12. In the base blank 10, the base-locking flaps 16 and the lid-locking flaps 17 are foldably connected to the side wall panels 12 along cut and scored, fold lines 18.

As also seen in FIG. 1, in the base blank 10, a spot of adhesive 19 is provided on each of the at least two, non-adjacent, side wall panels 12, provided with a base-locking flap 16. Each adhesive spot 19 is located adjacent a fold line 18 and at about the center of a side wall panel 12. The adhesive spots can be provided on either surface of the side wall panels 12, as long as they are so positioned that they can be overlain by the central, leading edge portions of the base-locking flaps 16, when the flaps 16 are folded about the fold lines 18. Preferably, the spots of adhesive 19 are applied to the surfaces of the side wall panels 12 which form the interior surfaces of the base formed from the blank 10.

As further seen in FIG. 1, in the base blank 10, the outer edges 14*a* of the triangular panels 14 of each gusset panel 13, remote from the bottom panel 11, are substantially colinear with the adjacent, lateral edge portions 16*a* of a base-locking flap 16, particularly with the adjacent, lateralmost extremities of the lateral edge portions 16*a* of a base-locking flap 16. By the term "substantially colinear" (with regard to the base blank 10) is meant that the angle included between the outer edges 14*a* of each gusset panel 13 and the adjacent, lateral edge portions 16*a*, particularly the adjacent, lateralmost extremities of the lateral edge portions 16*a*, of a base-locking flap 16 is 170° to 190°, preferably 170° to 180°, especially 172° to 178°, particularly 174° to 176°. In each of the preferred, trapezoidal base-locking flaps 16 of this invention, the two lateral edge portions 16*a* are the two lateral edges 16*a* of the trapezoidal flaps 16, each of which edges 16*a* includes an angle of 172° to 178°, preferably 174° to 176°, with the adjacent, outer edges 14*a* of a gusset panel 13. Also in the trapezoidal base-locking flaps 16, the lateral edge portions 16*a* are colinear with their lateralmost extremities, adjacent the outer edges 14*a* of the gusset panels 13.

The substantial colinearity of the lateralmost extremities of each of the lateral edge portions 16*a* (i.e., the lateralmost, lateral edge portions) of the base-locking flaps 16 and the adjacent, outer edges 14*a* of a gusset panel 13, in the base blank 10, is considered very important, and its purpose will be apparent from the description of the base formed from the base blank 10.

Shown in FIG. 2 is a paperboard blank, generally 20, for forming a lid member of the two-piece, polygonal container of this invention. The lid blank 20 includes a central, polygonal, top panel 21 of at least four sides or edges 21*a* and at least four, side wall panels 22, which are foldably connected to the sides 21*a* of the top panel 21.

The lid blank 20 also includes at least four, triangular gusset panels 23. Each gusset panel 23 is located between and foldably connected to two, adjacent, side wall panels 22. Each of the gusset panels 23 is formed from a pair of triangular panels 24. The triangular panels 24 in each gusset panel 23 are foldably connected along a cut and scored, fold line 25, between them. The fold line 25 in each gusset panel 23 is equidistant from the lateral edges of the adjacent, side wall panels 22.

The lid blank 20 further includes at least two, lid-locking flaps 26, foldably connected to at least two, side wall panels 22. The lid-locking flaps 26 are attached to the outer edges of the side wall panels 22, remote from the top panel 21. Preferably, each lid-locking flap 26 has a generally trapezoidal shape, the longer base of which is connected to a side wall panel 22. The lid-locking flaps 26 are connected to the side wall panels 22 along a plurality of cut and scored, fold lines 27.

As also seen in FIG. 2, each side wall panel 22 of lid blank 20 is provided with a spot of adhesive 28. Each adhesive spot 28 is located at a corner of a side wall panel 22, adjacent a gusset panel 23 and adjacent a fold line 27. The adhesive spots 28 can be applied to either surface of the side wall panels 22, so long as they are so positioned that they can be overlain by the gusset panels 23, when the gusset panels are folded about the fold lines connecting them to adjacent, side wall panels. It is preferred that the spots of adhesive 28 be provided on the surfaces of the side wall panels 22 which form the interior surfaces of the lid formed from the blank 20.

The relationships of the base panels and flaps 11, 12, 13, 14, 16 and 17 to the lid panels and flaps 21, 22, 23, 24 and 26 will be further discussed below in connection with FIGS. 3–6. However, it should be noted that particular dimensions and configurations of the flaps and panels of the base blank 10 and lid blank 20, which form the base and lid of the two-piece container of this invention, are not critical.

On the other hand, as seen from FIGS. 1 and 2, the central, top panel 21 of the lid blank 20 is preferably larger than the central, bottom panel 11 of the base blank 10, and the sides 21*a* of the top panel 21 are preferably longer than the sides 11*a* of the bottom panel 11.

As also seen from FIGS. 1 and 2, the side wall panels 12 of base blank 10 are preferably longer (as measured between fold lines 18 and the sides 11*a* of bottom panel 11) than the side wall panels 23 of the lid blank 20 (as measured between fold lines 27 and the sides 21*a* of top panel 21). The base side wall panels 12 (as measured between adjacent gusset panels 13) are also preferably narrower than the lid side wall panels 22 (as measured between adjacent gusset panels 23).

As further seen from FIGS. 1 and 2, in the base blank 10, the sides 11*a* of the bottom panel 11 are somewhat shorter in length than the fold lines 18, and in the lid blank 20, the sides 21*a* of the top panel 21 are somewhat shorter than the fold lines 27. As a result, the side wall panels 12 and 22 of the base and lid blanks 10 and 20 are slightly trapezoidal in shape, the shorter bases of the trapezoidal, side wall panels 12 and 22 being connected to the sides 11*a* and 21*a* of the bottom panel 11 and top panel 21 and the longer bases connected to flaps 16 and 17, along fold lines 18, in blank 10 and to flaps 26, along fold lines 27, in blank 20. The trapezoidal shapes of the base side wall panels 12 and lid side wall panels 22 cause the resulting base and lid members to have slightly outwardly-tapered, side walls, which permit a plurality of such members to be nested in a stack.

Shown in FIG. 3 is the base member 30, formed from the base blank 10, and the lid member 31, formed from the lid blank 20. The base 30 and the lid 31 are adapted to form the preferred embodiment of the two-piece, polygonal container 32 of this invention.

As seen in FIG. 3, the base 30 includes the central, polygonal, bottom panel 11 of at least four sides and the at least four, upstanding, side wall panels 12, foldably connected to the sides 11*a* of the bottom panel 11. The base 30 also includes the at least four, triangular gusset panels 13, located between and foldably connected to the adjacent, side wall panels 12. The base 30 further includes the at least two, downwardly extending, base-locking flaps 16, foldably connected to the top or outer edges of the at least two, non-adjacent, side wall panels 12, along fold lines 18. In the base 30, the base-locking flaps 16 are folded downwardly, along fold lines 18, and the central, leading edge portions of the base-locking flaps 16 are bonded to the underlying surfaces of the side wall panels 12 by the adhesive spots 19. Each gusset panel 13 is folded so that it lies substantially flat against a surface of an adjacent side wall panel 12 and is overlain by one of the at least two, base-locking flaps 16. Preferably, the base-locking flaps 16, as folded along fold lines 18, extend inwardly and downwardly of the base 30 and are adhesively bonded to interior surfaces of the side wall panels 12. It is also preferred that each base-locking flap 16 overlie both adjacent, gusset panels 13.

As also seen in FIG. 3, the base 30 further includes the at least two, outwardly and downwardly extending, lid-locking flaps 17, which are foldably connected to the top or outer edges of the at least two other, non-adjacent, side wall panels 12, along fold lines 18. The leading edges of the lid-locking flaps 17 (remote from fold lines 18) are spaced away from the exterior surfaces of the side wall panels 12 due to the natural spring-back of the paperboard. The length of this spacing, between the leading edges of the lid-locking flaps 17 and the side walls panels 12, is not critical but is preferably between 1/16 and ¼ inch.

As further seen in FIG. 3, the overlap of the base-locking flaps 16 and the gusset panels 13 in the base 30 is not extensive.

Due to the substantial colinearity in the base blank 10 of the lateral edge portions 16*a* of the base-locking flaps 16, particularly the lateralmost extremities of the lateral edge portions 16*a*, and the adjacent, outer edges 14*a* of the gusset panels 13, in the base 30, the lateral edge portions 16*a* of the base-locking flaps 16, particularly the lateralmost extremities of the lateral edge portions 16*a*, and the underlying, top edges 14*a* of the gusset panels 13 are also substantially colinear. By the term "substantially colinear" (with regard to base 30) is meant that the angle included between the lateral edge portions 16*a*, particularly the lateralmost extremities of the lateral edge portions 16*a*, of the base-locking flaps 16 and the underlying, top edges 14*a* of the gusset panels 13 is no more than 10°, i.e., 0° to 10°. In the base 30, the lateralmost extremities of the lateral edge portions 16*a* can either overlap or be spaced from the top edges 14*a* of the gusset panels 13 by an angle of 0° to 10°. Preferably, the lateralmost extremitites of the lateral edge portions 16*a* overlap the top edges 14*a* of the gusset panels 13 by an angle of 2° to 8°, especially 4° to 6°.

As a result of this substantial colinearity in the base 30, the maximum distance that the lateral edge portions 16*a* of the base-locking flaps 16 overlap the underlying, top edges 14*a* of the gusset panels 13, e.g., at the maximum overlap points 16*b* on the edge of each base-locking flap 16, is never more than 5/16 inch, preferably a maximum of 1/16 to ¼ inch, particularly a maximum of 3/16 inch. However, if the lateralmost extremities of the lateral edge portions 16*a* overlap the top edges 14*a* of the gusset panels 13, this overlap is not substantial. This is because at their lateralmost, lateral edge portions, the base-locking flaps 16 are virtually colinear with the underlying, top edges 14*a* the gusset panels 13, the cosine of the included angle of 10° or less being almost negligible at the lateralmost, lateral edge portions of the base-locking flaps 16.

As still further seen in FIG. 3, the lid 31 includes the central, polygonal, top panel 21 of at least four sides 21*a* and the at least four, downwardly extending, side wall panels 22, connected to the sides 21*a* of the top panel 12. The lid 31 also includes the at least four, triangular gusset panels 23, located between and foldaby connected to the adjacent side wall panels 22. Each gusset panel 23 is folded so that it lies flat against a surface of a side wall panel 22, preferably against an interior surface of a side wall panel, and is held flat against the side wall panel 22 by the spot of adhesive 28.

The lid 31 further includes the at least two, inwardly and upwardly extending, lid-locking flaps 26, foldably connected to the bottom or outer edges of the at least two, side wall panels 22, along fold lines 27. The leading edges of the lid-locking flaps 26 (remote from fold lines 27) are spaced away from the interior surfaces of the side wall panels 22 due to the natural spring-back of the paperboard. The length of this spacing, between the leading edges of the lid-locking flaps 26 and the side wall panels 22, is not critical but is preferably between 1/16 and ¼ inch.

The lid 31 can be easily formed from the lid blank 20 merely by folding all the side wall panels 22 to a position substantially perpendicular to the top panel 21 and then folding the gusset panels 23 flat against the adjacent spots of adhesive 28 on the side wall panels 22. As a result, the spots of adhesive 28 hold all the side wall panels 22 in a fixed position, perpendicular to the top panel 21. After bonding all the gusset panels 23 to the adjacent, side wall panels 22, the lid-locking flaps 26 can be folded inwardly of the lid 31, along fold lines 27, to overlie the gusset panels 23 and the lower, interior portions of the side wall panels 22.

In a similar fashion, the base 30 can be formed from the base blank 10. The side wall panels 12 can be folded to a position substantially perpendicular to the bottom panel 11. The gusset panels 13 then can be folded flat against the surfaces of the adjoining, side wall panels 12 which are provided with the adhesive spots 19, preferably against the interior surfaces of the side wall panels 12. The base-locking flaps 16 can be folded along the fold lines 18 to overlie the gusset panels. Then, the base-locking flaps 16 can be bonded to the surfaces of the side wall panels 12 with the adhesive spots 19. In this way, the base-locking flaps 16 hold the gusset panels 13 against the surfaces of the at least two, non-adjacent, side wall panels 12. Also, all the side wall panels 12 are held in a fixed, upstanding position relative to the bottom panel 11. Then, the lid-locking flaps 17 can be folded outwardly of the base 30, along fold lines 18, to overlie the upper, exterior portions of the side wall panels 12.

As seen in FIG. 3, the spots of adhesive 19 on the base blank 10 and base 30 are so positioned on the side wall panels 12 that they do not contact the gusset panels 13 when the gusset panels are folded against the side wall panels or are overlain by the base-locking flaps 16. On the other hand, the spots of adhesive 28 in the lid blank 20 and lid 31 are so positioned that the gusset panels 23 completely overlie the spots of adhesive, and the spots of adhesive 28 do not contact the lid-locking flaps 26.

Shown in FIG. 4 is the two-piece, paperboard container 32, formed from the base 30 and lid 31. The container 32 is useful for sandwiches, hamburgers and the like, in accordance with the invention. The container 32 is particularly useful for high volume, food establishments which specialize in take-out service. The base and lid members 30 and 31 can be preformed and stored in nested stacks. Hence, there is no need to assemble these container members on the site of the food establishment. The base 30 can be easily and quickly filled with a sandwich or the like, or the food product can be put together in the base. The container 32 then can be closed merely by pushing the lid 31 downwardly over the base 30, so that the lid side wall panels 22 cover the upper portions of the base side wall panels 12. When filled with a heated, food product the container 32 protects the product against undue heat loss until the consumer opens the container.

As shown in FIG. 5, in the formed container 32, holding a sandwich 33, the lid 31 is held on the base 30 by means of interfolded, lid-locking flaps 17 and 26. Merely pushing the lid 31 downwardly over the base 30 causes the inwardly and upwardly extending, lid-locking flaps 26 on the lid to be engaged by the outwardly and downwardly extending, lid-locking flaps 17 on the base. In this way, the lid 31 and base 30 are held together to close the container 32.

In order to assure that the lid, lid-locking flaps 26 securely engage the base, lid-locking flaps 17, the lid, lid-locking flaps 26 are preferably longer (as measured from fold lines 27) than the base, lid-locking flaps 17 (as measured from fold lines 18). Also, to assure that the locking flaps on the base and lid 30 and 31 are in engagement after the lid is pushed downwardly over the base, it is preferred that all of the side wall panels 22 of the lid 31 be provided with a lid-locking flap 26. In the resulting, closed container 32 of FIG. 5, the leading, outwardly and downwardly extending edges of the lid-locking flaps 17 (remote from fold lines 18) in the base 30 extend outwardly of the leading, inwardly and upwardly extending edges of the lid-locking flaps 26 (remote from fold lines 27) on the lid 31.

In opening the container 32, the lid 31 can be forceably pulled from the base 30. Such pulling causes the lid-locking flaps 17 on the base 30 to fold upwardly, about the cut and scored, fold lines 18. Such pulling also causes the lid-locking flaps 26 on the lid 31 to fold downwardly, about the fold lines 27. In this way, the engagement of the lid-locking flaps 17 and 26 is released.

Figure 6:
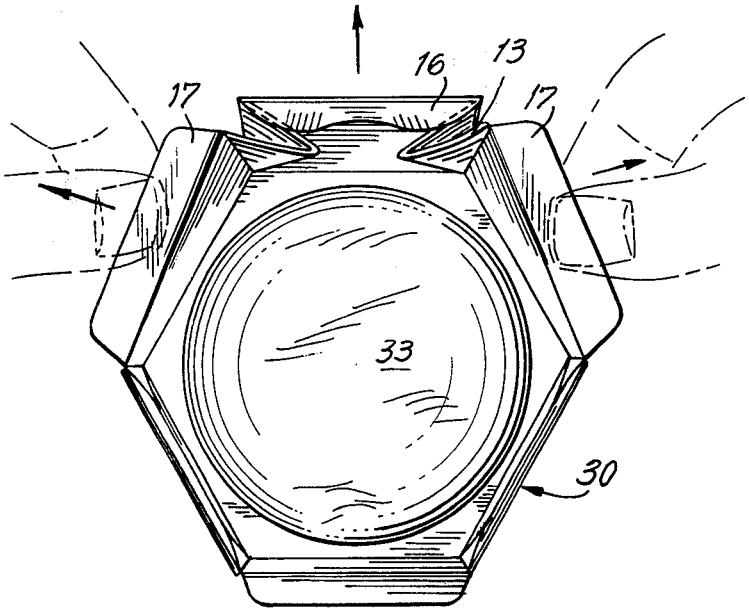
FIG. 6 is a top, elevational view of the base of the container of FIGS. 3–5. The procedure for disassembling the base to form a flat tray is shown.

Shown in FIG. 6 is the base 30, after the lid 31 has been removed from it, as by pulling the lid 31 off of the base 30. The container 32 is open, and the sandwich 33 inside the base 30 is ready to be eaten. For ease of eating the sandwich 33, the base 30 can be disassembled to form a flat plate. To form the plate, each of the at least two, outwardly extending, lid-locking flaps 17 is grasped and pulled radially outward of the base 30. Pulling outwardly on the lid-locking flaps 17 causes the gusset panels 13 to be pulled out from underneath the lateral edge portions 16a of the base-locking flaps 16. As a result, the side wall panels 12 are no longer held in a standing position, relative to the bottom panel 11, but, rather, are free to unfold into a flat position. The flat base 30 then can serve as a plate for the sandwich or the like 33.

Because the overlap of the top or outer edges 14*a* of the gusset panels 13 and the lateral edge portions 16*a* of the base-locking flaps 16 is relatively small, particularly at the lateralmost, lateral edge portions of the base-locking flaps 16, no substantial difficulty is encountered in pulling the gusset panels 13 out from under the base-locking flaps 16. Also, the risk of tearing or substantially deforming the elements of the base 30, when pulling on the lid-locking flaps 17, is not significant. In fact, providing an overlap of a maximum of 1/16 to ¼ inch, especially a maximum of 3/16 inch, and an included angle of 2° to 8°, especially 4° to 6°, between the lateral edges 16*a* of trapezoidal, base-locking flaps 16 and top or outer edges 14*a* of the gusset panels 13 permit the base 30 to be quite easily disassembled to form a flap plate, without substantial risk of tearing the base 30 or upsetting it or its food contents during the pulling on the lid-locking flaps 17.

Also, due to the fact that the lid-locking flaps 17 extend outwardly of the base 30, no substantial difficulty is encountered in firmly grasping and pulling the flaps 17 outwardly of the base 30.

Shown in FIG. 7 is a paperboard blank, generally 40, for forming a base member of a two-piece, polygonal container in accordance with an alternative embodiment of this invention. The elements of the base blank 40 are similar to the elements of the base blank 10. The base blank 40 includes a central, polygonal, bottom panel 41 of at least four sides or edges 41*a* and at least four, side wall panels 42, foldably connected to the sides 41*a* of the bottom panel 41. Foldably connected to each side wall panel 42, between adjacent, side wall panels, is a triangular gusset panel 43. The gusset panels 43 are formed from a pair of triangular panels 44, separated by a cut and scored, fold line 45, equidistant from adjacent, side wall panels 42. A base-locking flap 46 is foldably connected to each of at least two, non-adjacent, side wall panels 42, along cut and scored, fold lines 47. The fold lines 47 are located along the outer edge of each of the at least two, side wall panels 42, remote from the bottom panel 41. The base blank 40 further includes a spot of adhesive 48 on each of the at least two, non-adjacent, side wall panels 42. The spots of adhesive 48 are provided adjacent the fold lines 47, at about the center of the side wall panels 42.

As seen from FIG. 7, in the base blank 40, the lateral edge portions 46*a* of each base-locking flap 46, particularly the lateralmost extremities of each of the lateral edge portions 46*a*, are substantially colinear with the outer edges 44*a*, remote from the bottom panel 41, of the adjacent, triangular panels 44 of a gusset panel 43, i.e., include an angle with the outer edges 44*a* of 170° to 190°, preferably 170° to 180°, especially 172° to 178°, particularly 174° to 176°. Also, in each of the preferred, trapezoidal base-locking flaps 46, wherein the longer base is attached to the side wall panels 42, the two lateral edge portions 46*a* are the two lateral edges 46*a* of the trapezoidal flaps 46, each of which edges 46a includes an angle of 172° to 178°, preferably 174° to 176°, with the outer edges 44*a* of the adjacent, gusset panels 43. Also, in the trapezoidal base-locking flaps, the lateral edge portions 46*a* and their lateralmost extremities, adjacent the outer edges 44*a* of the gusset panels 43, are colinear.

As with the base blank 10 of the first embodiment of this invention, the substantial colinearity of the lateralmost extremities of the lateral edge portions 46*a* (i.e., the lateralmost, lateral edge portions) of the base-locking flaps 46 and the adjacent, outer edges 44*a* of the gusset panels 43 in the blank 40 is considered very important in accordance with this invention.

Shown in FIG. 8 is a plastic lid 50. The lid 50 is formed as one, continuous piece. It may be formed by any conventional method of forming one piece, plastic lids, such as by thermoforming or injection molding. It also may be formed from any conventional plastic material used in connection with packages for food products and the like, such as polyethylene or polypropylene.

The plastic lid 50 includes a channel or groove 51, around the perimeter of the lid 50. As seen in FIG. 8, the channel 51 comprises at least four, discrete segments 51*a*. Each segment 51*a* substantially conforms to the length and thickness of the outer edges of the side wall panels 42, remote from the bottom panel 41, in the base blank 40. The lid 50 also includes a depending, outer, peripheral skirt 52, coextensive with the outer wall of channel 51. The plastic lid 50 further includes a central, elevated, panel portion 53 surrounded by the channel 51. The elevated panel portion 53 preferably has the approximate shape of the sandwich contents to be placed in the base, formed from the base blank 40.

Figure 9:
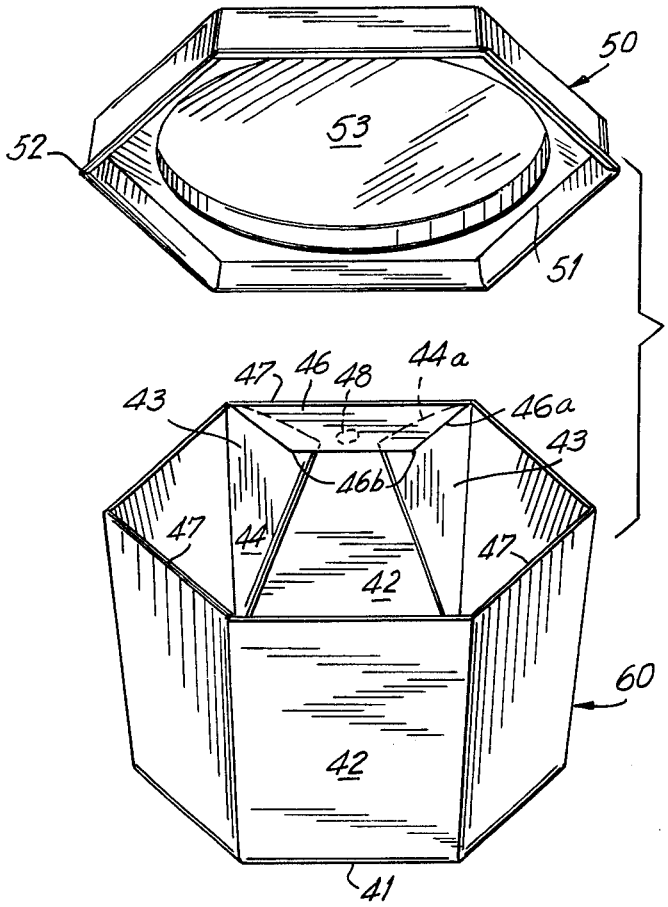
FIG. 9 is an exploded, perspective view of a two-piece, polygonal container of this invention. The base is formed from the blank of FIG. 7, and the lid is the preformed, plastic lid of FIG. 8.

Shown in FIG. 9 is the base 60 formed from the base blank 40 of FIG. 7. The base 60 in combination with the plastic lid 50 of FIG. 8 form the two-piece container 61 in accordance with the alternative embodiment of this invention.

As seen in FIG. 9, the base 60 includes the central, polygonal, bottom panel 41 of at least four sides 41*a* and the at least four, upstanding, side wall panels 42, foldably connected to the sides of the bottom panel. The base 60 also includes the at least four, triangular gusset panels 43, each located between and foldably connected to two, adjacent, side wall panels 42. The base 60 further includes the at least two, downwardly extending, base-locking flaps 46, foldably connected to the top or outer edges of the at least two, non-adjacent, side wall panels 42, along fold lines 47. Each gusset panel 43 is folded so that it lies substantially flat against a surface of an adjacent, side wall panel 42 and is overlain by one of the at least two, base-locking flaps 46. Each base-locking flap 46 is bonded by means of the spot of adhesive 48 to a surface, preferably the interior surface, of the side wall panel 42 to which it is attached. It is also preferred that each base-locking flap 46 overlie both adjacent, gusset panels 43. As in the base 30, the spots of adhesive 48, on the at least two, non-adjacent, side wall panels 42, contact only the base-locking flaps 46 and not the gusset panels 43.

As also seen in FIG. 9, in the base 60, as in the base 30, each of the lateral edge portions 46*a* of the base-locking flaps 46, particularly the lateralmost extremities of each of the lateral edge portions 46*a*, is substantially colinear with the top edges 44*a* of an underlying, gusset panel 43, i.e., includes an angle with the top edges 44*a* of no more than 10°. In the base 60, the lateralmost extremities of the lateral edge portions 46*a* can overlap or be spaced from the top edges 44*a* of the gusset panels 43 by an angle of 0° to 10°. Preferably, the lateralmost extremities of the lateral edge portions 46*a* overlap the top edges 44*a* of the gusset panels 43 by an angle of 2° to 8°, preferably 4° to 6°. Also, in base 60, as in base 30, the maximum overlap of the lateral edge portions 46*a* of the base-locking flaps 46 and the underlying, top edges 44 *a* of the gusset panels 43, e.g., at the maximum overlap points 46*a* on the edge of each base-locking flap 46, is never more than 5/16 inch, preferably a maximum of 1/16 to ¼ inch, particularly a maximum of 3/16 inch.

Figure 10:
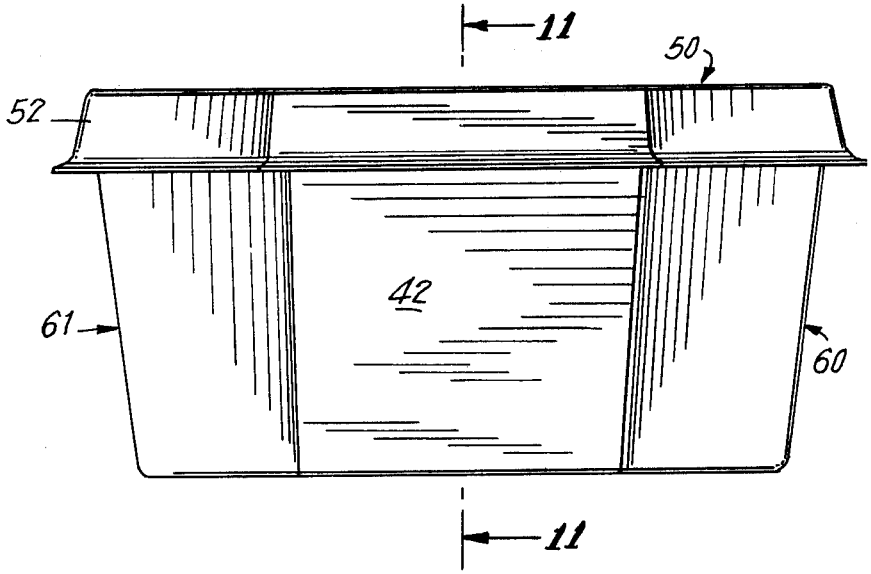
FIG. 10 is a front, plan view of the container of this invention, shown in FIG. 9.

Shown in FIG. 10 is a two-piece container 61 in accordance with the alternative embodiment of this invention. The container 61 is formed from the plastic lid 50 and the base 60 of FIG. 9. As with the container 32 of this invention, the container 61 is useful or sandwiches, hamburgers and the like. It is particularly useful for high volume, food establishments specializing in take-out service. The base and lid members 60 and 50 can be performed and held in nested stacks. There is no need to assemble the container members on the site of the food establishment. The base can be easily and quickly filled with a sandwich or the like, or the food product can be put together in the base 60. The container 61 then can be closed merely by pushing the lid 50 downwardly over the filled base 60.

Figure 11:
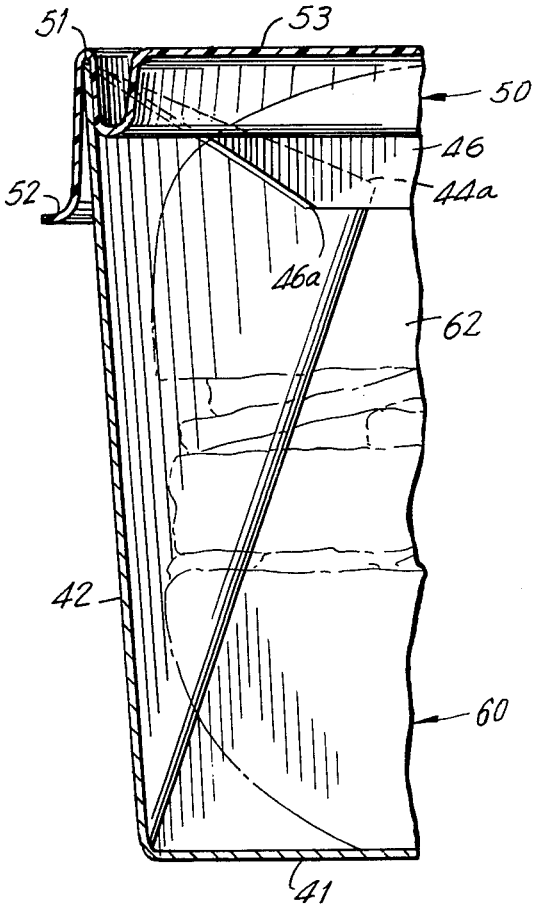
FIG. 11 is a fragmentary, sectional view taken along line 11—11 in FIG. 10.

As shown in FIG. 11, in the formed container 61, holding a sandwich 62, the lid 50 is held on the base 60. The top edge of each upstanding side wall panel 42 is positioned in a segment 51*a* of the channel 51 of the lid 50, and the depending skirt 52 of the lid covers the upper portions of the side wall panels 42 of the base 60. As also seen in FIG. 11, the lid 50 fits snugly onto the top portions of the base 60, with each of the at least four segments 51*a* of the channel 51 frictionally engaging each of the top edges of the side wall panels 42. The frictional engagement of the top edges of the side wall panels 42 and the segments 51*a* of the channel 51 hold the lid and base together when the container 61 is closed.

Figure 12:
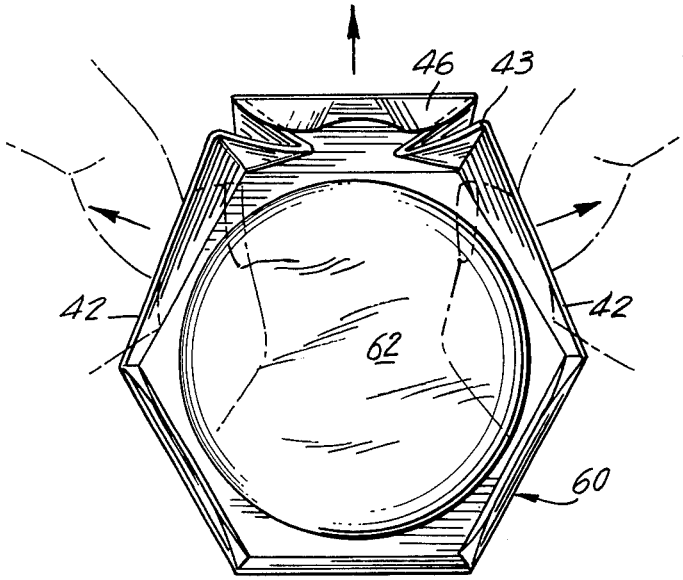
FIG. 12 is a top, elevational view showing the base of FIGS. 9—11. The procedure for disassembling the base to form a flat tray is shown.

Shown in FIG. 12 is the base 60, after the lid 50 has been removed from it, as by pulling the lid 50 off of the base 60. The container 61 is open, and the sandwich 62 inside the base 60 is ready to be eaten. For ease of eating the sandwich 62, the base 60 can be disassembled to form a flat plate.

To form a flat plate, each of the gusset panels 43 is pulled out from underneath each of the base-locking flaps 46 on the at least two, non-adjacent, side wall panels 42. This can be done by grasping and pulling on the top edges of the at least two other, side wall panels 42 adjacent to the base-locking flaps 46. As a result, the side wall panels 42 are no longer held in a standing position and are free to unfold into a flat position. In a flat position, the base 60 can serve as a plate for eating the sandwich or the like 62.

In disassembling the base 60, as in disassembling the base 30 of the first embodiment of this invention, the gusset panels 43 can be easily pulled out from under the base-locking flaps 46. No excessive force is required, and the risk of tearing or substantially deforming the elements of the base 60, when grasping and pulling on the side wall panels 42, is not significant.

In the base members 30 and 60 of this invention, the design of the base-locking flaps 16 and 46 and their relationship to the gusset panels 13 and 43 is considered critical. The relative dimensions of the base-locking flaps 16 and 46 and the gusset panels 13 and 43 must be such that the bases 30 and 60 can be securely held together, i.e., the gusset panels can be held tightly between the base-locking flaps and the side wall panels 12 and 42. At the same time, the base-locking flaps and the gusset panels must be adapted so that the bases 30 and 60 can be easily disassembled to form a flat plate, i.e., the gusset panels can be pulled out from between the base-locking flaps and the side wall panels, without ripping or substantially deforming the bases.

While trapezoidal, base-locking flaps 16 and 46 are preferred, other configurations can be utilized. Among the shapes of base-locking flaps which can be used are the parabolic shapes, the lateral edge portions 16*a* and 46*a* of which: (1) do not overlap the top or outer edges 14*a* and 44*a* of the gusset panels 13 and 43 by more than about 5/16 inch, preferably a maximum of about 1/16 to ¼ inch, particularly a maximum of about 3/16 inch; and (2) are substantially colinear, particularly at their lateralmost extremities (i.e., lateralmost, lateral edge portions), with the adjacent, top or outer edges 14*a* and 44*a* of the gusset panels 13 and 43.

In the containers 32 and 61 of this invention, the cut and scored, fold lines 15, 18, 25, 27, 45 and 47 are also very important. However, in these containers, particular cut and scored configurations are not critical. Any cut and scored, fold lines can be provided, so long as: the gusset panels 13 and 43 can be folded about fold lines 15, 25 and 45 so that they lie substantially flat, against the surfaces of the side wall panels 12, 22 and 42; the base-locking flaps 16 and 46 can be folded about fold lines 18 and 47 so that they are held substantially flat against the side wall panels 12 and 42 by the adhesive spots 19 and 48; and the lid-locking flaps 17 and 26 are relatively free to fold about the fold lines 18 and 27.

Also in the containers 32 and 61 of this invention, the spots of adhesive 19, 28 and 48 can suitably be any conventional adhesive utilized to bond paperboard panels together. The adhesive can be a cold set resin adhesive, such as polyvinyl acetate, or a hot melt resin adhesive. Preferably, the spots of adhesive 19, 28 and 48 are spots of a hot melt adhesive. It is also preferred that the spots of adhesive 19, 28 and 48 be applied to the surfaces of the base and lid blanks 10, 20 and 40 at the time these blanks are formed into their respective base and lid members 30, 31 and 60.

Further in the polygonal containers of this invention, the number of elements is not critical, and the containers can suitably be square, pentagonal, hexagonal, heptagonal, octogonal, nonagonal, decagonal, etc. The preferred containers of this invention have 6 or 8 sides. The particularly preferred containers of this invention, shown in the Drawings, are the hexagonal containers, having a base with: a hexagonal bottom panel 11 and 41, six side wall panels 12 and 42, six gusset panels 13 and 43, three or four, preferably three, base-locking flaps 16 and 46 and, if desired, two or three, preferably three, lid-locking flaps 17 and 46; and having a lid with: a hexagonal top panel 21, six side wall panels 22, six gusset panels 23, and two to six, preferably six, lid-locking flaps 26; or having a preformed, plastic lid with a channel 51 having six segments 51*a*.

Still further in the polygonal containers, the exact size and configuration of the elements are not critical. Preferably, the bottom and top panels 11, 21 and 41 are equilateral, polygonal panels, and the side wall panels 12, 22 and 42, in each base or lid member, are of equal size. Also in the containers, the placement of the adhesive spots 19, 28 and 48 can, if desired, be on the base-locking flaps 16 and 46 and on the lid, triangular panels 24, rather than on the side wall panels 12, 22 and 42.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the form hereinbefore described being merely preferred embodiments thereof.

I claim:

1. In a two-piece, polygonal container having a paperboard base which includes: a central, polygonal, bottom panel of at least four sides; at least four, upstanding, side wall panels, foldably connected to the sides of the bottom panel; at least four, triangular gusset panels, each gusset panel being located between and foldably connected to two, adjacent, side wall panels; and at least two, downwardly extending, base-locking flaps, foldably connected to the top edges of at least two, non-adjacent, side wall panels; the central, leading edge portions of each base-locking flap being bonded to the underlying surface of a side wall panel; and each of the gusset panels being folded so that it lies substantially flat against a surface of a side wall panel and is overlain by a base-locking flap; the improvement which comprises:

the top edges of each gusset panel including an angle of 0° to 10° with the lateralmost, lateral edge portions of an overlying, base-locking flap;

the lateral edge portions of each base-locking flap overlapping the top edges of a gusset panel by no more than 5/16 inch;

a spot of adhesive being provided on a surface of each of the at least two, non-adjacent, side wall panels for bonding the leading edge portions of the base-locking flaps to the underlying surfaces of the side wall panels; the spots of adhesive being so located that they do not contact the gusset panels; and each base-locking flap overlying two adjacent gusset panels.

2. The two-piece container of claim 1 wherein the lateralmost, lateral edge portions of each base-locking flap and the top edges of a gusset panel overlap and include an angle of about 2° to 8°.

3. The two-piece container of claim 2 wherein the top edges of each gusset panel are overlain by the lateral edge portions of a base-locking flap by a maximum of about 1/16 to ¼ inch.

4. The two-piece container of claim 1 wherein the base-locking flaps have a substantially trapezoidal shape.

5. The two-piece container of claim 1 wherein the base further includes at least two, outwardly and downwardly extending, lid-locking flaps, foldably connected to the top edge of at least two other, non-adjacent, side wall panels.

6. The two-piece container of claim 5 wherein the container includes a paperboard lid, covering the base, having a central, polygonal, top panel of at least four sides; at least four, downwardly extending, side wall panels, overlying a portion of the outer surfaces of the side wall panels of the base; and at least two, inwardly and upwardly extending, lid-locking flaps, foldably connected to the bottom edge of at least two side wall panels of the lid; the leading edges of the lid-locking flaps on the base extending outwardly of the leading edges of the lid-locking flaps on the lid.

7. A cut and scored, paperboard blank for the base of a two-piece container, which comprises:

a central, polygonal panel of at least four sides;

at least four, side wall panels, foldably connected to the sides of the central panel;

at least four, triangular gusset panels, each gusset panel being located between and foldably connected to two, adjacent, side wall panels; and at least two, base-locking flaps, foldably connected to the outer edges of at least two, non-adjacent, side wall panels;

the outer edges of each gusset panel including an angle of 170° to 190° with the adjacent, lateralmost, lateral edge portions of a base-locking flap;

each of the at least two, non-adjacent, side wall panels being adapted to be provided with a spot of adhesive on a surface thereof for bonding the leading edge portions of the base-locking flaps to surfaces of the at least two, non-adjacent, side wall panels;

each of the gusset panels being adapted to be folded so that it lies substantially flat against a surface of one of the at least two, non-adjacent, side wall panel and is overlain by a base-locking flap;

the at least two, non-adjacent, side wall panels being further adapted so that the spots of adhesive can be located where they do not contact the gusset panels, when the gusset panels are folded against surfaces of the at least two, non-adjacent, side wall panels; and each base-locking flap being adapted to overlie two adjacent gusset panels, when the gusset panels are folded against surfaces of the at least two, non-adjacent, side wall panels.

8. The blank of claim 7 wherein the base-locking flaps have a substantially trapezoidal shape.

9. The blank of claim 8 wherein the outer edges of each gusset panel and the adjacent, lateralmost, lateral edge portions of a base-locking flap include an angle of about 172° to 178°.

* * * * *